US006026525A

United States Patent [19]

Davis

[11] Patent Number: 6,026,525

[45] Date of Patent: Feb. 22, 2000

[54] FOLDABLE INFANT MATTRESS SYSTEM WITH SLEEPING RECESS

[75] Inventor: Shirley Louise Davis, Selah, Wash.

[73] Assignee: Bumpa Bed Company, LLC, Yakima, Wash.

[21] Appl. No.: 09/165,008

[22] Filed: Sep. 30, 1998

[51] Int. Cl.[7] ..... A47D 7/00

[52] U.S. Cl. ..... 5/99.1; 5/655; 5/732

[58] Field of Search ..... 5/99.1, 722, 732, 5/655

[56] References Cited

U.S. PATENT DOCUMENTS

| | | | |
|---|---|---|---|
| D. 288,636 | 3/1987 | McLaren | D6/383 |
| 1,473,370 | 11/1923 | Heller | 5/424 |
| 2,626,407 | 1/1953 | Kurry | 5/99.1 |
| 3,321,779 | 5/1967 | Kauffman et al. | 5/93 |
| 3,619,824 | 11/1971 | Doyle | 5/93 |
| 3,639,927 | 2/1972 | Munch | 5/91 |
| 3,742,528 | 7/1973 | Munch | 5/91 |
| 3,761,975 | 10/1973 | Personett | 5/348 |
| 3,803,646 | 4/1974 | Newerowski | 5/732 X |
| 4,081,868 | 4/1978 | Hull | 5/12 |
| 4,190,916 | 3/1980 | McMullan | 5/451 |
| 4,198,718 | 4/1980 | Ballard | 5/99.1 |
| 4,234,977 | 11/1980 | Snow | 5/110 |
| 4,286,344 | 9/1981 | Ikeda | 5/424 |
| 4,449,261 | 5/1984 | Magnusson | 5/465 |
| 4,517,693 | 5/1985 | Viesturs | 5/451 |
| 4,607,402 | 8/1986 | Pollard | 5/425 |
| 4,628,557 | 12/1986 | Murphy | 5/446 |
| 4,670,923 | 6/1987 | Gabriel et al. | 5/424 |
| 4,672,698 | 6/1987 | Sands | 5/424 |
| 4,754,509 | 7/1988 | Pollard | 5/425 |
| 4,788,726 | 12/1988 | Rafalko | 5/93 R |
| 4,872,228 | 10/1989 | Bishop | 5/425 |
| 4,873,734 | 10/1989 | Pollard | 5/425 |
| 4,934,002 | 6/1990 | Watanabe | 5/61 |
| 4,953,246 | 9/1990 | Matthews | 5/424 |
| 4,980,940 | 1/1991 | Isshiki | 5/468 |
| 4,999,863 | 3/1991 | Kane | 5/99.1 |
| 5,010,611 | 4/1991 | Mallett | 5/497 |
| 5,044,027 | 9/1991 | Moon | 5/448 |
| 5,103,514 | 4/1992 | Leach | 5/417 |
| 5,107,558 | 4/1992 | Luck | 5/464 |
| 5,261,133 | 11/1993 | Wilkerson | 5/655 |
| 5,343,575 | 9/1994 | Cartwright | 4/547 |
| 5,351,348 | 10/1994 | Beger | 5/420 |
| 5,359,740 | 11/1994 | Markley et al. | 5/425 |
| 5,455,973 | 10/1995 | Brumfield et al. | 5/424 |
| 5,822,817 | 10/1998 | Carew et al. | 5/732 |

FOREIGN PATENT DOCUMENTS

| | | | |
|---|---|---|---|
| 133498 | 7/1949 | Australia | 5/99.1 |
| 2211401 | 7/1989 | United Kingdom . | |

*Primary Examiner*—Michael F. Trettel
*Attorney, Agent, or Firm*—Seed and Berry LLP

[57] ABSTRACT

A foldable infant mattress system with a sleeping recess. A head mattress section is hingedly connected to a foot mattress section. Each mattress sections include an end wall and two laterally spaced apart sidewalls traversed to the end wall. The foldable infant mattress system is deployed in a flat position for sleeping and foldable into a closed position for carrying. In the flat position, the end wall and sidewalls of each mattress section together form the recess which contains an infant to a sleeping area. The walls are of sufficient thickness to allow for sound structural support and effective restraint of the infant. In the closed position, the mattress sections form a compact, easily carried assembly. A closing device such as a combination of straps and a snap is used which also forms a handle for carrying the mattress system. The mattress system is constructed of a foam material which is air permeable.

21 Claims, 3 Drawing Sheets

FOLDABLE INFANT MATTRESS SYSTEM WITH SLEEPING RECESS

TECHNICAL FIELD

The present invention relates generally to beds and specifically to an infant mattress system with a sleeping recess.

BACKGROUND OF THE INVENTION

Infant beds must not only provide comfort but also provide a safe environment in which roaming by an infant is limited to the sleeping area of the bed. Prior art infant beds have relied upon such barriers as guardrails to prevent the infant from leaving the sleeping area of the bed. Various protection devices such as bumpers made of a cushioning material are also used so that the infant does not harm himself on the guardrails. Investigations into crib accidents and bedtime activities of infants have shown that some of these cushion devices come loose, provided footholds, have been of limited effectiveness or have created other hazards.

For portable infant beds, other problems must be addressed. The infant bed must be lightweight and compact enough to be portable. Yet on the other hand, the infant bed still must provide safe confinement for the infant. Prior art portable infant beds include collapsible walls that provide limited structural support for infant restraint. Other prior art portable infant beds require additional guardrails or accessories which limit the portability of the infant bed. With both the collapsible walls and additional guardrails and accessories of the prior art infant beds, many steps are required in deploying the infant bed in a flat bed configuration and packing the infant beds in a portable configuration. These many steps reduce the portability of the infant beds. In past systems, however, infant beds that are easier to deploy and pack have lacked sufficient restraining qualities so that the infant beds are less safe.

It therefore can be appreciated that an infant bed that is both easy to deploy and pack and also provides safe and structurally sound restraint for the infant would be most desirable. The present invention fulfills these needs and further provides other related advantages.

SUMMARY OF THE INVENTION

The present invention resides in a portable mattress system comprising first and second mattress sections movable relative to each other between a flat bed configuration and a totable configuration with the first and second mattress sections in face-to-face juxtaposition. Each mattress section includes a base, a pair of sidewalls, and an end wall positioned at one of the ends of the base. Each base has spaced-apart sides, opposing, spaced-apart ends, and a central sleeping surface. The sidewalls are each positioned at a different one of the opposing ends of the base and project away from the base to a defined height relative to the central sleeping surface. The end wall projects away from the base to a defined height relative to the central sleeping surface. The end wall also extends substantially fully between the side walls of the base. The portable mattress system further includes at least one connector connecting the first and second mattress sections together, at least when in the bed configuration with the bases of the first and second mattress sections in generally coplanar relation. When in the bed configuration, the central sleeping surfaces of the bases of the first and second mattress sections in combination form a recessed sleeping surface of sufficient size to accommodate at least a prone infant. When in the bed configuration, one of the pair of sidewalls of each of the bases is in general alignment, and the other of the pair of sidewalls of each of the bases is in general alignment to form in combination sidewalls on opposing sides of the recessed sleeping surface extending substantially the full length of the recessed sleeping surface. The sidewalls and end walls of the bases are of sufficient height to restrict movement of the sleeping infant beyond the periphery of the recessed sleeping surface. The first and second mattress sections are movable into the totable configuration with the bases of the first and second mattress sections in generally parallel, spaced-apart relation.

The first and second mattress sections further include a cover contoured to enclose the base, sidewalls, and end wall thereof. The covers of the first and second mattress sections are attached together by at least one connector. In a preferred embodiment, the at least one connector includes first and second hinges. The first hinge connects one adjacent connected end of the first and second mattress sections together, and the second hinge connects the other of the connected ends of the first and second mattress sections together. The first and second hinges are positioned away from the central sleeping surface of the bases of the first and second mattress sections.

The mattress system further includes a water impervious panel in alignment with the recessed sleeping surface when in the bed configuration. The water impervious panel extends between the central sleeping surfaces of the bases of the first and second mattress sections to provide a bridging support extending across the juncture of the central sleeping surfaces. The mattress system also includes a releasable securing device configured to maintain the bases of the first and second sections in generally parallel, spaced-apart relation when in the totable position. This securing device is further configured to comprise a handle for grasping the mattress system.

Other features and advantages of the invention will become apparent from the following detailed description, taken in conjunction with the accompanying drawings.

DETAILED DESCRIPTION OF THE INVENTION

Figure 1:
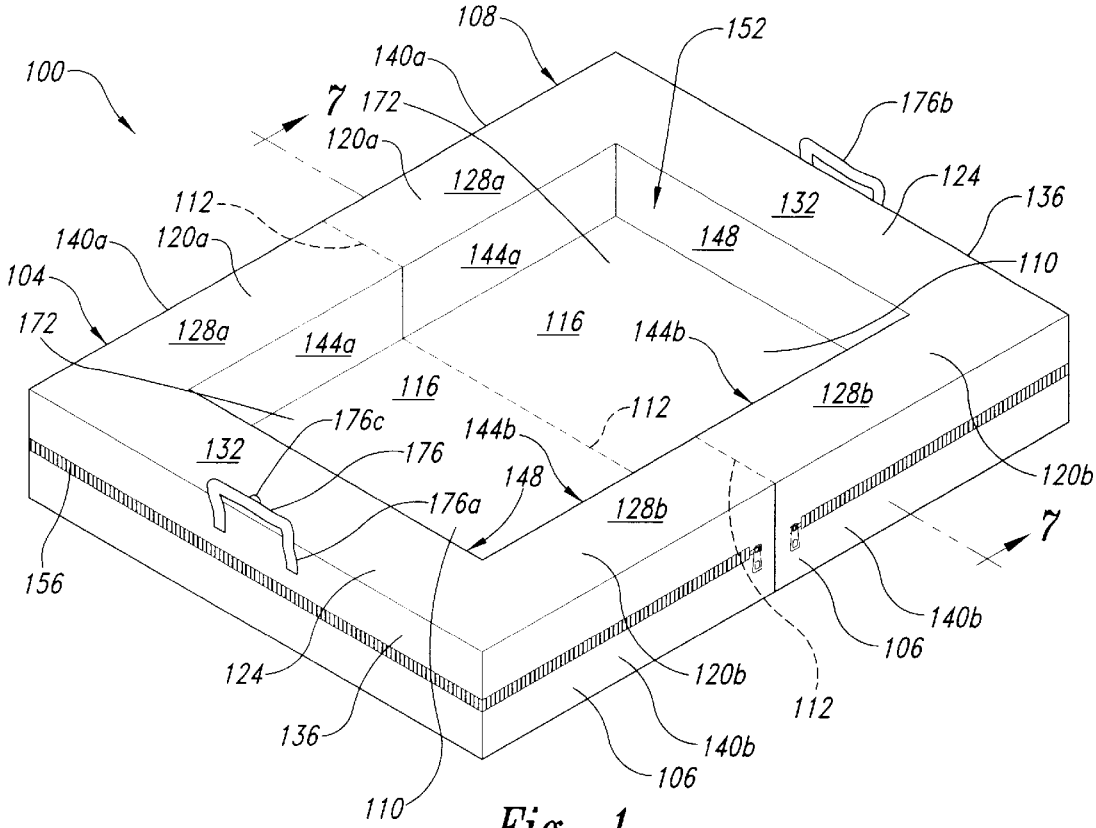
FIG. 1 is a perspective view of the infant mattress system of the present invention.
Figure 6:
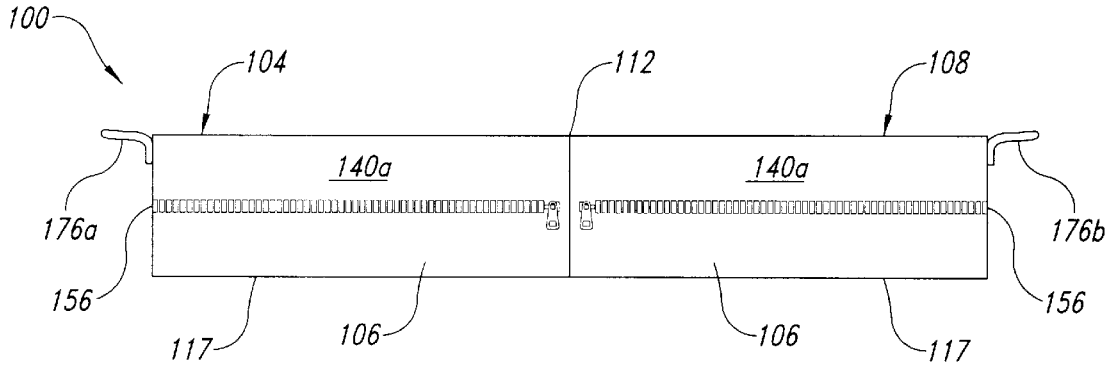
FIG. 6 is a side elevational view of the mattress system of FIG. 1 in an unfolded bed configuration for sleeping.

As shown in the drawings for the purposes of illustration, the present invention is embodied in a foldable infant mattress system with a sleeping recess, as indicated generally by reference numeral 100. The portable mattress system 100 is comprised of a foot mattress section 104 and a head mattress section 108 joined together by a hinge 112. Each mattress section 104 and 108 includes a central mattress portion 110 having a recessed top surface 116 upon which an infant (not shown) sleeps. Each mattress section 104 and 108 further includes a bottom surface 117 which is placed against the supporting floor or other surface when the portable mattress system 100 is used for sleeping an infant, as shown in FIGS. 1 and 6.

Each of the mattress sections 104 and 108 includes spaced apart left and right rails or sidewalls 120*a* and 120*b*, and an end wall 124 arranged in a U-shape. The sidewalls 120*a* and 120*b* each have an upper surface 128*a* and 128*b*, respectively, and the end wall 124 has an upper surface 132. The sidewalls 120*a* and 120*b* each also have an outer surface 140*a* and 140*b*, respectively, and an inner surface 144*a* and 144*b*, respectively. The end wall 124 has an outer surface 136 and inner surface 148.

Each of the foot and head mattress sections 104 and 108 is enclosed by a fabric cover 106 which fully encloses the respective mattress section. Each of the fabric covers 106 includes a zipper 156 to allow insertion and removal of resilient foam pieces that are held together by the fabric cover to form the foot and head mattress sections. Although in the depicted embodiment, zippers 156 are used, in other embodiments, snaps, buttons, ties stitching or other fastening devices known in the art are used.

The fabric cover 106 for the foot mattress section 104 has two portions of fabric material which cover the upper surfaces 128*a* and 128*b* of the sidewalls 120*a* and 120*b* of the foot mattress section 104. Likewise, the fabric cover 106 for the head mattress section 108 has two portions of fabric material which cover the upper surfaces 128*a* and 128*b* of the sidewalls 120*a* and 120*b* of the head mattress section 108. The fabric material portions of the covers 106 which cover the upper surfaces 128*a* and 128*b* of the foot and head mattress sections 104 and 108 are formed from a continuous sheet of fabric which bridges across the juncture of the respective upper surfaces 128*a* and 128*b* of the sidewalls 120*a* and 120*b* of foot and head mattress sections 104 and 108 at two locations along the laterally extending midline of the portable mattress system 100, shown in broken line in FIG. 1, to form two fabric hinge portions comprising the hinge 112. The sidewalls 120*a* and 120*b* of one mattress section abut and are each hinged to the corresponding positioned one of the sidewalls 120*a* and 120*b* of the other mattress section by the continuous sheet forming the portions of the covers 106 covering the upper surfaces 128*a* and 128*b* along this midline.

In an alternative embodiment, the hinge 112 may be formed by sewing together the covers 106 at the midline.

The inner sidewall surfaces 144*a* and 144*b*, the inner end wall surface 148, and the top surface 116 of the foot and head mattress sections 104 and 108, when in a fully flat bed configuration shown in FIG. 1, define a recess 152 sized to receive and contain therein an infant when sleeping in a stretched out position.

The sidewalls 120*a* and 120*b* and the end walls 124 of the portable mattress system 100 each have a height extending above the top surface 116 of the central mattress portion 110 sufficient to restrain an infant from rolling off of the central mattress portion 110 while sleeping thereon. The sidewalls 120*a* and 120*b* and the end walls 124 also have sufficient thickness to provide rigidity and sound structural support so as to be self supporting and also withstand the force applied thereto by a sleeping infant. Prior art portable infant mattress systems typically have thin walls which do not provide sufficient structural support. Further, the prior art systems typically are walls hingedly affixed to a base which further lessens their structural support. The sidewalls 120*a* and 120*b* and the end walls 124 of the depicted embodiment have a wide stance and are firmly held in place by the fabric covers 106 against the top surface of the central mattress portion 110 which adds to their stability. The stability further enhances the restraining and safety qualities provided by the sidewalls and end walls.

Figure 2:
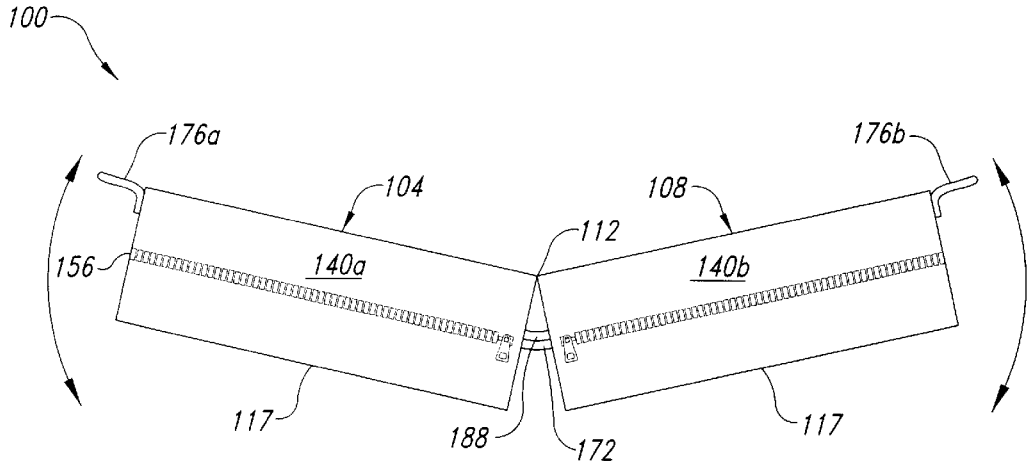
FIG. 2 is a side elevational view of the mattress system of FIG. 1 showing the mattress sections partially pivoting about a hinge.

Since the foot mattress section 104 and the head mattress section 108 are hingedly connected by the fabric hinge 112, these sections can rotate about the axis of hinge 112 as illustrated in FIG. 2. Rotation about the axis of hinge 112 allows the portable mattress system 100 to be folded from the fully flat position of the bed configuration depicted in FIGS. 1 and 6 to an intermediate position depicted in FIG. 2 and finally to a closed, portable position of a totable configuration depicted in FIGS. 3–5.

Figure 3:
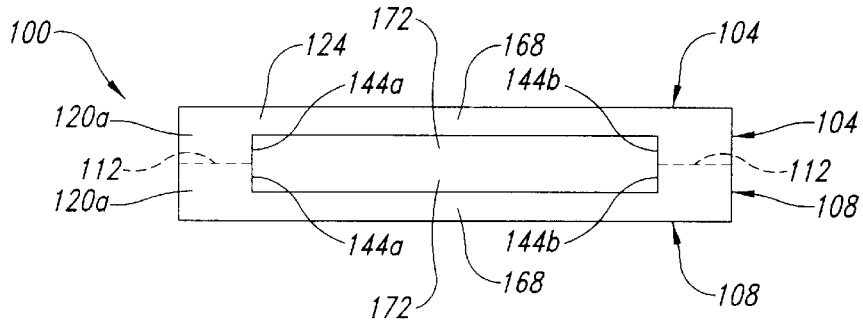
FIG. 3 is an end elevational view of the mattress system of FIG. 1 pivoted into a fully folded totable configuration for carrying.
Figure 4:
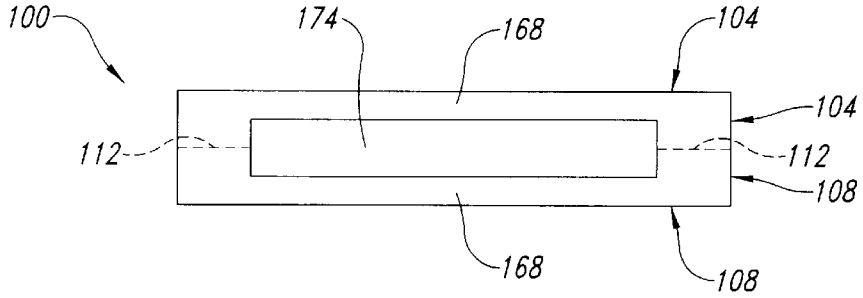
FIG. 4 is an end elevational view of the mattress system of FIG. 3 using an end cover sheet.
Figure 5:
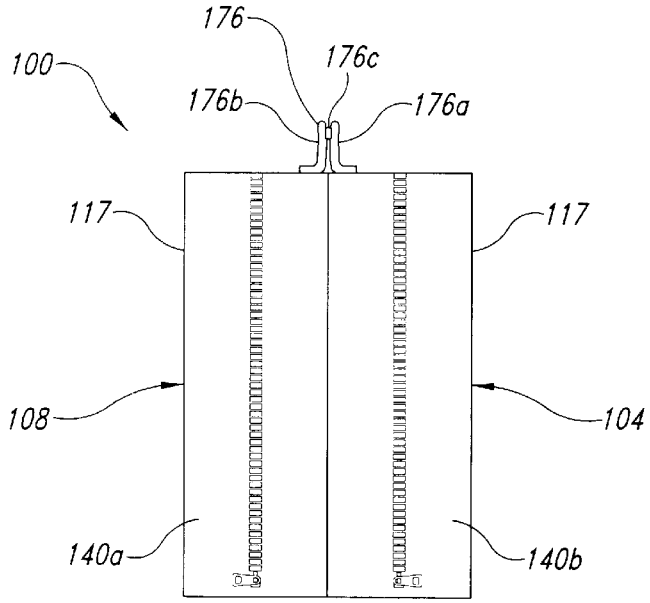
FIG. 5 is a side elevational view of the mattress system of FIG. 1 in the fully folded totable configuration for carrying, shown rotated to place a handle thereof in an upward position.

When the portable mattress system 100 is in the closed, portable position as shown in FIGS. 3, 4 and 5, the foot mattress section 104 and head mattress section 108 are held folded together and held in face-to-face juxtaposition against unfolding by a handle 176. As best shown in FIG. 5, the handle 176 has a first looped strap 176*a* fixedly attached to the foot mattress section 104 and a second looped strap 176*b* fixedly attached to the head mattress section 108. The first and second looped straps 176*a* and 176*b* also include a fastening device 176*c*, such as a loop and hook system, a snap or button or other fasteners known in the art, to fasten the first and second looped straps together at their midpoint. By fastening the first and second looped straps of handle 176 together, the portable mattress system 100 is secured in its closed, portable position of the totable configuration. The handle 176 in the depicted embodiment is used to facilitate carrying the portable mattress system 100. However, in other embodiments other devices such as shoulder straps are used to carry the portable mattress system 100. These specific examples of carrying devices are not intended to limit the present invention to the particular devices depicted. Instead, any device which allows for carrying of items is contemplated by the present invention.

The fabric covers 106 for the foot and head mattress sections 104 and 108 each include a water impervious panel portion 172 which covers the top surface 116 of the central mattress portion 110. The panel portions 172 of the fabric cover 106 are formed as a continuous sheet which spans over the midline of the portable mattress system 100, whereat the ends of the sidewalls 120*a* and 120*b* of the foot and head mattress sections 104 and 108 abut when in the bed configuration of FIGS. 1 and 6. The continuous sheet of the panel portions 172 thereby bridges over any gap that might exist between the central mattress portions 110 of the foot and head mattress sections 104 and 108 when in the fully flat sleeping position and support the sleeping infant from entry into the gap. In the embodiment of the portable mattress system 100 depicted in FIG. 4, a fabric end sheet 174 is sewn to each of the fabric covers 106 at the foot and head mattress sections 104 and 108, at a position to be below the panel portion 172, to close the opening that exists between the mattress sections along the midline when in the closed, portable position of the totable configuration.

As can be seen by examining FIGS. 1, 2 and 3, only a simple folding step is required to transition between the fully flat sleeping position of the bed configuration and the closed, portable position of the totable configuration. The simplicity of operation as a result of the diminished number of steps required allows for increased ease of use which is a welcome advancement over prior art portable mattress systems.

One reason for the diminished number of steps required to operate the portable mattress system 100 is that the sidewalls 120*a* and 120*b*, and the end walls 124 do not fold down or collapse but remain fixed to the mattress sections 104 and 108 in the same upright position relative to the central mattress portion 110 of the mattress section in both the fully flat, bed position and the closed, portable position.

The portable mattress system 100 also includes in the depicted embodiment a sheet panel 188 positioned over and removably attached to the continuous sheet forming the water impervious panel portions 172.

Figure 7:
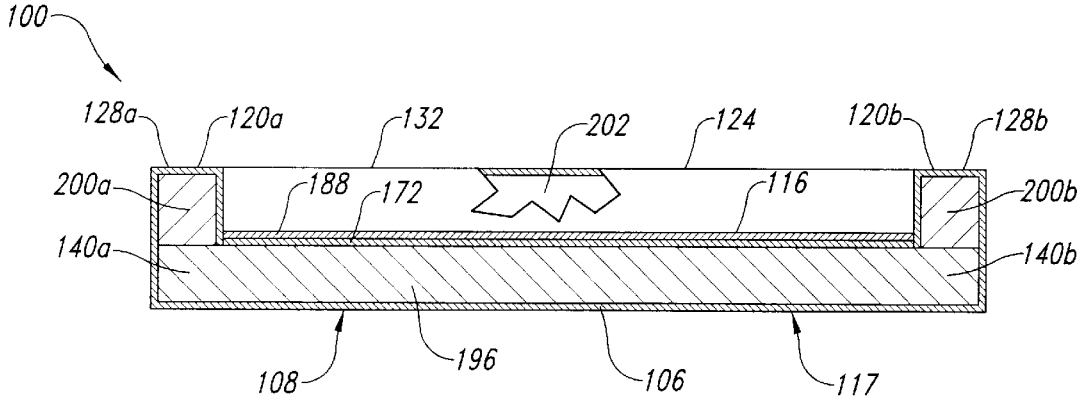
FIG. 7 is a cross-sectional view taken along section lines 2—2 of FIG. 1 showing internal components of the mattress system of FIG. 1.

As previously noted, the covers 106 are used to enclose their respective mattress sections 104 and 108. Each of the mattress sections includes a base foam piece 196 which forms the central mattress portion 110, a pair of left and right foam pieces 200*a* and 200*b* which form the left and right sidewalls 120*a* and 120*b*, and a foam piece 202 which forms the end wall 124, as shown in FIG. 7. The sidewall foam pieces 200*a* and 200*b* and the end wall foam piece 202 are securely held in position above the base foam piece 196 by the cover 106 which tightly encloses the same. In another embodiment, these foam pieces are affixed to the base foam piece 196 by other methods such as gluing, sewing, stapling, etc. or are formed integral therewith from a block of foam. These examples are not intended to limit the present invention. Instead, the present invention also includes other methods known in the art to secure foam members together.

In the depicted embodiment, the base foam piece 196, sidewall foam pieces 200*a* and 200*b* and the end wall foam piece 202 are constructed of a foam material which provides a significant degree of air permeability. The air permeability typically used in the depicted embodiment is in a range which provides a maximum pressure drop of 20 mm of $H_2O$ at a test air flow of 25 scfm. Air permeability further enhances the safety aspects of the portable mattress system 100. Air permeability can be especially helpful in situations such as when an infant places his face directly against a portion of a mattress section.

The recess 152 in which the infant is placed for sleeping is constructed of a sufficient size to accommodate an infant in a prone position and to allow a comfortable amount of movement while restricting movement to the central mattress portion 110 of the portable mattress system 100. The overall dimensions of the base foam piece 196 in the depicted embodiment are generally about 28 inches wide by about 52 inches long. In such a portable mattress system 100, the recess 152 of 20 inches wide by 44 inches long provides a peripheral barrier of 4 inches wide fully surrounding the recess. It is desirable in the depicted embodiment that the peripheral barrier be at least 4 inches wide to provide structural stability and restrain the infant placed in the recess 152. In other embodiments, the dimensions are modified appropriately to accommodate other sizes of individuals. For comfort and ease of maintenance, the covers 106 are constructed of a soft polyester and cotton blend of 65% and 35%, respectively, in the depicted embodiment although other fabrics known in the art are used in other embodiments.

In the depicted embodiment the sheet panel 188 is constructed of a polyester and cotton blend material and is provided with strips of loop type fastener material along the full perimeter of its lower surface to secure the sheet panel 188 to corresponding hook type fasteners of the water impervious panel portions 172 of the covers 106. The hook or loop type fastener material can be of the style sold under the trademark VELCRO. The water impervious panel portion 172 in the depicted embodiment is made out of a vinyl material and is provided with strips of loop type fasteners along the full perimeter of its lower surface to removably secure the water impervious panel portion 172 to corresponding hook type fasteners of the base foam piece 196.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A portable mattress system comprising:

first and second mattress sections configured to be movable between a flat bed configuration and a folded totable configuration, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface; and an end wall positioned at one of the ends of the base, the end wall projecting away from the base to a defined height relative to the central sleeping surface, the end wall extending substantially fully between the sidewalls of the base; and at least one hinge connecting the first and second mattress sections together, at a location away from the end walls thereof for pivotal movement of the first and second mattress sections relative to each other between the bed configuration with the bases of the first and second mattress sections in generally coplanar relation and the totable configuration with the bases of the first and second mattress sections in generally parallel, spaced-apart relation, when in the bed configuration the central sleeping surfaces of the bases of the first and second mattress sections in combination form a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface, wherein each of the first and second mattress sections further includes a cover contoured to enclose the base, sidewalls and end wall thereof, and the covers of the first and second mattress sections are attached together to form the at least one hinge.

2. The mattress system of claim 1, further including a water impervious panel in alignment with the recessed sleep surface when in the bed configuration, the water impervious panel extending between the central sleeping surfaces of the bases of the first and second mattress sections to provide a bridging support extending across the juncture of the central sleeping surfaces.

3. The mattress system of claim 1, further including a releasable securing device configured to maintain the bases of the first and second mattress sections in generally parallel, spaced-apart relation when in the totable position.

4. The mattress system of claim 3 wherein the securing device is further configured to comprise a handle for grasping the mattress system.

5. A portable mattress system comprising:

first and second mattress sections configured to be movable between a flat bed configuration and a folded totable configuration, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface; and an end wall positioned at one of the ends of the base, the end wall projecting away from the base to a defined height relative to the central sleeping surface, the end wall extending substantially fully between the sidewalls of the base; and at least one hinge connecting the first and second mattress sections together, at a location away from the end walls thereof for pivotal movement of the first and second mattress sections relative to each other between the bed configuration with the bases of the first and second mattress sections in generally coplanar relation and the totable configuration with the bases of the first and second mattress sections in generally parallel, spaced-apart relation, when in the bed configuration the central sleeping surfaces of the bases of the first and second mattress sections in combination form a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface, wherein each of the sidewalls of the base of each of the first and second mattress sections has a hinged end, one of the hinged ends of the base of the first mattress section and one of the hinged ends of the base of the second mattress section being positioned adjacent to each other, and the other one of the hinged ends of the base of the first mattress section and the other one of the hinged ends of the base of the second mattress section being positioned adjacent to each other, and wherein the at least one hinge includes first and second hinges, the first hinge connecting the one adjacent hinged ends of the first and second mattress sections together and the second hinge connecting the other hinged ends of the first and second mattress sections together.

6. The mattress system of claim 5 wherein the first and second hinges are positioned away from the central sleeping surfaces of the bases of the first and second mattress sections.

7. The mattress system of claim 5 wherein each of the first and second mattress sections further includes a cover contoured to enclose the base, sidewalls and end wall thereof, and the covers of the first and second mattress sections are attached together by attachments at two spaced-apart locations to form the first and second hinges.

8. The mattress system of claim 7 wherein the locations of the cover attachments forming the first and second hinges are away from the central sleeping surfaces of the bases of the first and second mattress sections.

9. The mattress system of claim 8 wherein the cover attachments are formed by a continuous sheet of material forming a portion of the covers at the two locations.

10. A portable mattress system comprising:

first and second mattress sections configured to be movable between a flat bed configuration and a folded totable configuration, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface; and an end wall positioned at one of the ends of the base, the end wall projecting away from the base to a defined height relative to the central sleeping surface, the end wall extending substantially fully between the sidewalls of the base;

at least one hinge connecting the first and second mattress sections together, at a location away from the end walls thereof for pivotal movement of the first and second mattress sections relative to each other between the bed configuration with the bases of the first and second mattress sections in generally coplanar relation and the totable configuration with the bases of the first and second mattress sections in generally parallel, spaced-apart relation, when in the bed configuration the central sleeping surfaces of the bases of the first and second mattress sections in combination form a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface;

a water impervious panel in alignment with the recessed sleep surface when in the bed configuration, the water imprevious panel extending between the central sleeping surfaces of the bases of the first and second mattress sections to provide a bridging support extending across the juncture of the central sleeping surfaces; and a panel of sheeting material in alignment with the recessed sleep surface and outward of the water impervious panel when in the bed configuration, the panel of sheeting material having a first attachment device secured thereto and the water impervious panel having a mating second attachment device secured thereto for releasably attaching the panel of sheeting material to the water impervious panel.

11. A portable mattress system comprising:

first and second mattress sections configured to be movable between a flat bed configuration and a folded totable configuration, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface, each of the sidewalls comprising air permeable foam; and an end wall positioned at one of the ends of the base, the end wall projecting away from the base to a defined height relative to the central sleeping surface, the end wall extending substantially fully between the sidewalls of the base; and at least one hinge connecting the first and second mattress sections together, at a location away from the end walls thereof for pivotal movement of the first and second mattress sections relative to each other between the bed configuration with the bases of the first and second mattress sections in generally coplanar relation and the totable configuration with the bases of the first and second mattress sections in generally parallel, spaced-apart relation, when in the bed configuration the central sleeping surfaces of the bases of the first and second mattress sections in combination form a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface.

12. A portable mattress system comprising:

first and second mattress sections configured to be movable between a flat bed configuration and a folded totable configuration, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface;

an end wall positioned at one of the ends of the base, the end wall projecting away from the base to a defined height relative to the central sleeping surface, the end wall extending substantially fully between the sidewalls of the base; and a cover configured to enclose the base, sidewalls and end wall thereof, and hold the sidewalls and end wall in place relative to the base; and at least one hinge connecting the first and second mattress sections together, at a location away from the end walls thereof for pivotal movement of the first and second mattress sections relative to each other between the bed configuration with the bases of the first and second mattress sections in generally coplanar relation and the totable configuration with the bases of the first and second mattress sections in generally parallel, spaced-apart relation, when in the bed configuration the central sleeping surfaces of the bases of the first and second mattress sections in combination form a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface.

13. A portable mattress system comprising:

first and second mattress sections movable relative to each other between a flat bed configuration and a totable configuration with the first and second mattress sections in face-to-face juxtaposition, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface;

an end wall positioned at one of the ends of the base, the end wall projecting away from the base to a defined height relative to the central sleeping surface, the end wall extending substantially fully between the sidewalls of the base; and a cover contoured to enclose the base, sidewalls and end wall thereof; and at least one connector connecting the first and second mattress sections together, at least when in the bed configuration with the bases of the first and second mattress sections in generally coplanar relation, the covers of the first and second mattress sections being attached together by at least one connector, when in the bed configuration the central sleeping surfaces of the bases of the first and second mattress sections in combination forming a recessed sleeping surface of sufficient size to accommodate at least a prone infant, and one of the pair of sidewalls of each of the bases being in general alignment and the other of the pair of sidewalls of each of the bases being in general alignment to form in combination widewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface, the first and second mattress sections being movable into the totable configuration with the base of the first and second mattress sections in generally parallel, spaced-apart relation.

14. A portable mattress system comprising:

first and second mattress sections movable relative to each other between a flat bed configuration and a totable configuration with the first and second mattress sections in face-to-face juxtaposition, each mattress section comprising:

a base having opposing, spaced-apart sides, opposing, spaced-apart ends, and a central sleeping surface;

a pair of sidewalls, each positioned at a different one of the opposing sides of the base and projecting away from the base to a defined height relative to the central sleeping surface; and an end wall positioned at one of the ends of the base, the end wall projecting away from the base to a defined height relative to the central sleeping surface, the end wall extending substantially fully between the sidewalls of the base; and at least one connector connecting the first and second mattress sections together, at least when in the bed configuration with the bases of the first and second mattress sections in generally coplanar relation, when in the bed configuration the central sleeping surfaces of the bases of the first and second mattress sections in combination forming a recessed sleeping surface of sufficient size to accommodate at least a prone infant, and one of the pair of sidewalls of each of the bases being in general alignment and the other of the pair of sidewalls of each of the bases being in general alignment to form in combination sidewalls on opposing sides of the recessed sleeping surface extending substantially the full length of the recessed sleeping surface, the sidewalls and end walls of the bases being of sufficient height to restrict movement of the sleeping infant beyond the periphery of the recessed sleeping surface, the first and second mattress sections being movable into the totable configuration with the bases of the first and second mattress sections in generally parallel, spaced-apart relation, wherein each of the sidewalls of the base of each of the first and second mattress sections has a connected end, one of the connected ends of the base of the first mattress section and one of the connected ends of the base of the second mattress section being positioned adjacent to each other, and the other one of the connected ends of the base of the first mattress section and the other one of the connected ends of the base of the second mattress section being positioned adjacent to each other, and wherein the at least one connector includes first and second hinges, the first hinge connecting the one adjacent connected ends of the first and second mattress sections together and the second hinge connecting the other connected ends of the first and second mattress sections together.

15. The mattress system of claim 14 wherein the first and second hinges are fabric hinges.

16. The mattress system of claim 14 wherein the first and second hinges are positioned away from the central sleeping surfaces of the bases of the first and second mattress sections.

17. The mattress system of claim 14 wherein each of the first and second mattress sections further includes a cover contoured to enclose the base, sidewalls and end wall thereof, and the covers of the first and second mattress sections are attached together by attachments at two spaced-apart locations to form the first and second hinges.

18. The mattress system of claim 17 wherein the locations of the cover attachments forming the first and second hinges are away from the central sleeping surfaces of the bases of the first and second mattress sections.

19. The mattress system of claim 13, further including a water impervious panel in alignment with the recessed sleep surface when in the bed configuration, the water impervious panel extending between the central sleeping surfaces of the bases of the first and second mattress sections to provide a bridging support extending across the juncture of the central sleeping surfaces.

20. The mattress system of claim 13, further including a releasable securing device configured to maintain the bases of the first and second mattress sections in generally parallel, spaced-apart relation when in the totable position.

21. The mattress system of claim 20 wherein the securing device is further configured to comprise a handle for grasping the mattress system.

* * * * *